United States Patent [19]

Iimura et al.

[11] Patent Number: 4,641,896

[45] Date of Patent: Feb. 10, 1987

[54] RETRACTABLE DOOR STRUCTURE

[76] Inventors: Kyosuke Iimura, 1-2-13 Higashi Tabata, Kita-ku, Tokyo; Kiyoshi Maruyama, 716 Kamitsuchidana, Ayase-shi, Kanagawa, both of Japan

[21] Appl. No.: 869,460

[22] Filed: May 28, 1986

Related U.S. Application Data

[63] Continuation of Ser. No. 675,821, Nov. 28, 1984, abandoned.

[30] Foreign Application Priority Data

Dec. 26, 1983 [JP] Japan ..... 58-198613[U]

[51] Int. Cl.[4] ..... E06B 00/00

[52] U.S. Cl. ..... 312/110; 49/257; 312/109

[58] Field of Search ..... 312/110, 109, 111; 49/257, 254, 258, 259, 260

[56] References Cited

U.S. PATENT DOCUMENTS

| | | | |
|---|---|---|---|
| 644,434 | 2/1900 | Macey | 312/110 |
| 962,228 | 6/1910 | Kuersten | 49/257 |
| 1,386,738 | 8/1921 | Sonnenberg | 49/257 |
| 3,339,995 | 9/1967 | Bencene | 312/110 |
| 4,058,932 | 11/1977 | Peterson et al. | 49/257 |
| 4,375,907 | 3/1983 | Kooi et al. | 312/110 |

*Primary Examiner*—Kenneth J. Dorner
*Assistant Examiner*—Gerald A. Anderson
*Attorney, Agent, or Firm*—Koda and Androlia

[57] ABSTRACT

A retractable door structure for a storage case including a pair of guide grooves formed from the front end to the back end of the inner surfaces of the case panel, sliding blocks connected to each other by a connecting rod provided in the guide grooves, and a pinion mounted in each of the sliding blocks which is designed to engage with a rack formed in the guide grooves. The door is pivotally held between the sliding blocks by rotary shafts attached to the corners of the door. By means of this structure, the door can be slid inside the case after it is opened and the door is easily pushed in and pulled out of the case since the sliding blocks holding the door slide smoothly in the guide grooves.

4 Claims, 8 Drawing Figures

RETRACTABLE DOOR STRUCTURE

This is a continuation of application Ser. No. 675,821, filed Nov. 28, 1984 now abandoned.

BACKGROUND OF THE INVENTION

1. Field of the Invention

This invention relates to a door frame structure and more particularly to a retractable door structure for storage cases such as a cabinet, etc.

2. Prior Art

Generally, the door of a cabinet is hinged at its one side to the cabinet and opened toward the person opening it and then pushed sideways in order to secure a working space in front of the cabinet. In this manner, the space in front of the cabinet has to be left open for working on the articles to be put in or taken out of the cabinet as well as for performing other work to be done in front of the cabinet.

In most of the cases, the door of a cabinet is made of glass and therefore broken easily. It is also likely that the doors and fitting assemblies are damaged and distorted when force or impact is applied thereto. Further, the articles put into and out of the cabinet must always be moved away from the front area of the cabinet so that the door can be opened and closed and the desired work can be done in front of the cabinet without any trouble.

To eliminate such inconvenience, some of today's cabinets are designed such that the open-out door is pushed into the cabinet along the side panel of a cabinet to leave an open space in front of the cabinet after the door is opened. However, in existing cabinets, the door is likely to tilt when it is pushed in, resulting in that one side of the door is pushed more strongly and fed farther than the other side. Thus, it is not easy to push the door smoothly into the cabinet without damaging the door and its fitting assemblies.

Further, in a case that a gear shaft which holds and guides the door into the cabinet is designed integral with a rotary axle for the door, a large gap is formed at the side of the gear shaft when the door is closed. Also, since this type of gear shaft can be seen from the front of the cabinet, the appearance of the cabinet is not very pleasant to the eyes.

SUMMARY OF THE INVENTION

Therefore, the general object of this invention is to eliminate the drawback of the door structures in the prior art.

It is another object of this invention to provide a retractable door structure which ensures a smooth movement or storage of the door for a storage case such as a cabinet, etc.

It is still another object of this invention to provide a retractable door structure which assures a good aesthetic appearance for a storage case.

These and other objects of the present invention are accomplished by a unique structure for the retractable door including a pair of guide grooves formed on the panels of a case and sliding blocks which are set in each of the guide grooves. The sliding blocks are connected by a connecting rod, and rotary shafts attached to the door for supporting the door are mounted on each one of the sliding block so that the door can be pushed in and pulled out of the cabinet by means of the sliding blocks. The door is held pivotally on the sliding blocks by the rotary shafts so that no space is formed at the side of the rotary shafts when the door is closed and so that the rotary shafts of the door are not seen from the front of the cabinet.

DETAILED DESCRIPTION OF THE INVENTION

Detailed description will hereunder be given on a representative embodiment with reference to the drawings.

A cabinet 1 for storing articles such as audio appliances, etc. is provided with a single or double swing (hinged) doors 2 for closing the front of the cabinet. Each one of the doors 2 is mounted pivotally on the cabinet 1 so as to be opened and closed freely.

The door can be mounted on a cabinet in several ways.

Figure 1:
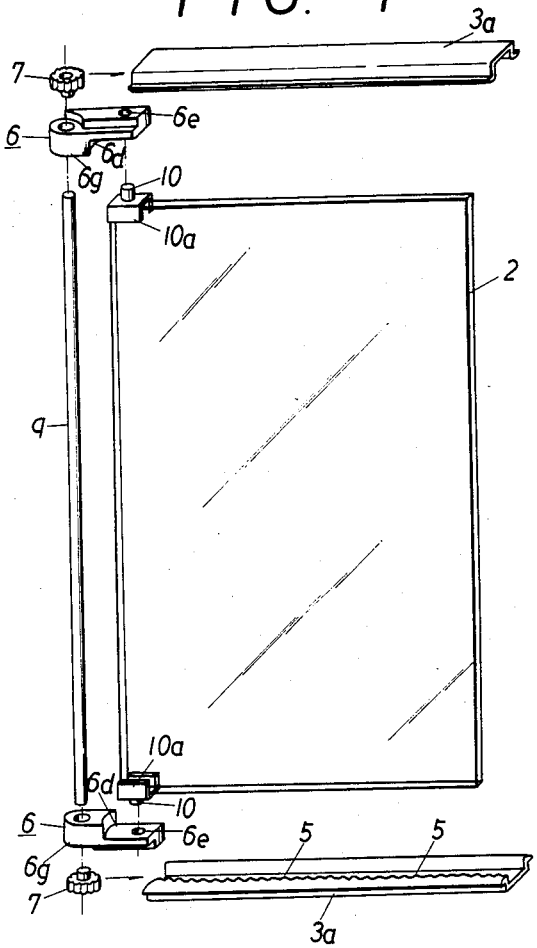
FIG. 1 is an exploded perspective view of a door frame structure according to the present invention.
Figure 4:
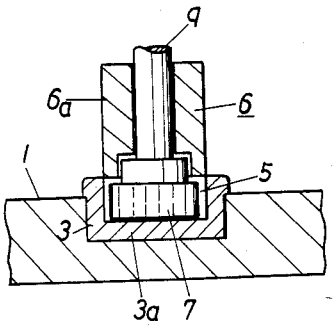
FIG. 4 is a sectional front view thereof.
Figure 3:
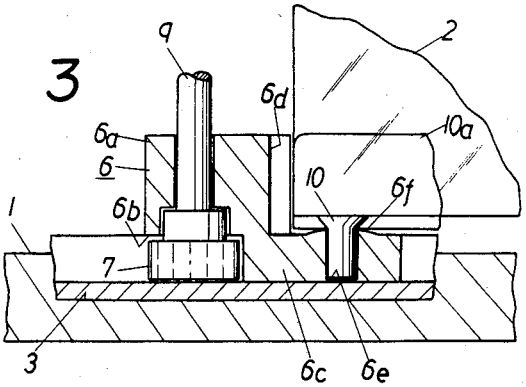
FIG. 3 is a sectional side view thereof.
Figure 2:
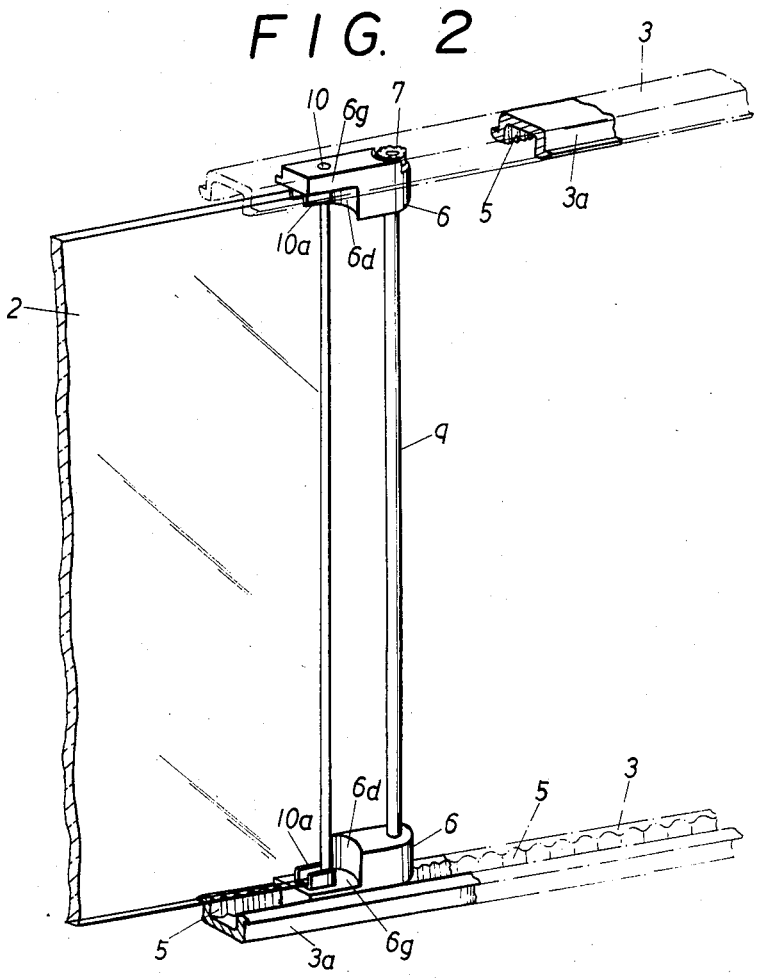
FIG. 2 is a perspective view of the assembled essential parts of the door frame.
Figure 5:
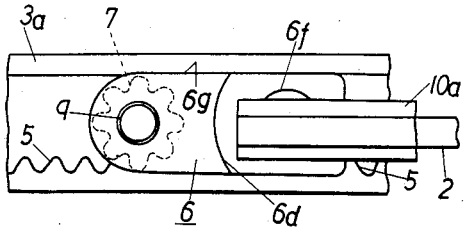
FIG. 5 is a plan view thereof.
Figure 6:
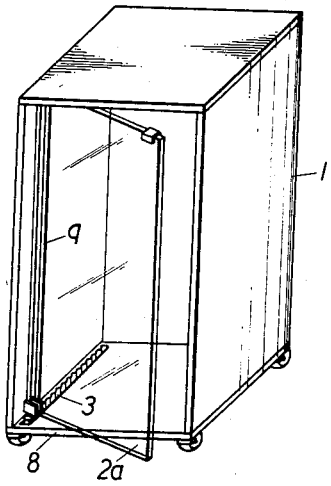
FIGS. 6 and 7 are perspective views showing the manners mounting the door to a case.

In FIG. 6, grooves 3 are formed on the upper and lower inner surfaces of the panels of the cabinet or on the upper inner surfaces of the panels of the cabinet 1. The door 2*a*, held by sliding blocks (which are described later), each of the blocks being in its respective groove, slides along these grooves 3 when it is pushed in and pulled out of the cabinet.

Figure 7:
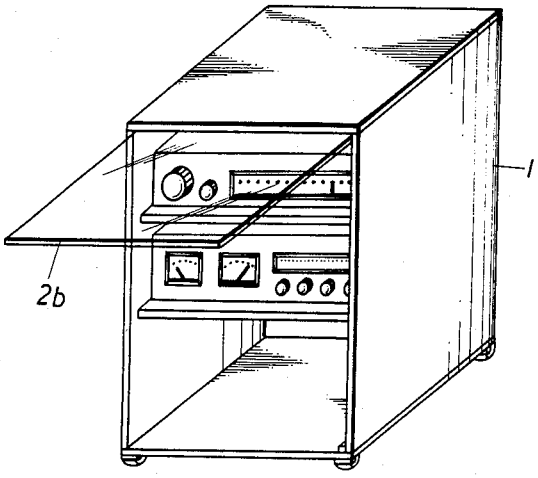

The door 2*b* in FIG. 7 is a hung type door. In this type, the grooves 3 are formed on the upper inner surfaces of the panels of the cabinet 1 so that the bottom edge of the door 2*b* is raised until the door is in a horizontal position and then pushed into the cabinet along these grooves after the door is fully opened.

Figure 8:
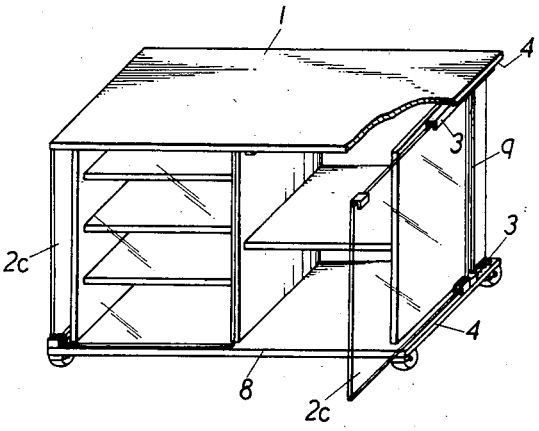
FIG. 8 is a partially cutaway perspective view showing the manner mounting the door to a case.

The structure in FIG. 8 is such that the top and bottom panels of the cabinet 1 are extended beyond the side panels, and the grooves 3 are formed on each of the extended edges of the top and bottom panels, in other words on the under surface of the top panel and on the upper surface of the bottom panel. Thus, the door 2 can be positioned on the outer surface of the side panel of the cabinet when it is opened and pushed in.

The door structure of this invention is applicable not only to the cabinets of the above types but also to any type of doors for storage cases and is intended to be used as a general closing means for containers, etc.

Each one of the grooves 3 is provided therein with a rack 5, and a sliding block 6 is fitted in the rack 5 in a manner such that a pinion 7 mounted in the sliding block 6 engages with the the rack 5. The grooves 3 are formed such that a gutter form groove member 3*a* with the rack 5 is set in grooves formed on the cabinet panels. Also, for the purpose of preventing the sliding blocks 6 from coming off the grooves and for decorating the front of the cabinet, a decorative panel 8 is attached to the front sides of the grooves 3.

The sliding blocks 6 are fitted in each of the grooves 3, and these two sliding blocks 6 in the grooves 3 facing to each other are connected by a connecting rod 9.

Pinions 7 are attached on the both ends of the rod 9 so that the pinions 7 engage with the rack 5.

The sliding block 6 includes a bearing portion 6*a* for holding the shaft 9, a storing space 6*b* for storing the pinion 7, a sliding edge 6*c* for insertion into the groove 3, and a scraped portion 6*d* for supporting one edge of the door 2.

The scraped portion 6*d* is further provided with a fixing hole 6*e* for rotary shaft 10 attached on the door 2 and a bulged bearing portion 6*f* for facilitating the smooth opening and closing of the door 2. In order for the sliding block 6 to slide smoothly in the groove 3, the surfaces of the wall of the groove 3 where the rack 5 is not formed, or where the surfaces whereon the pinion 7 does not engage with the rack 5, are designed such that the flat and smooth edge surface 6*g* of the sliding block 6 is kept in close contact with the surface of the wall 3*a* of the groove 3 when the sliding block 6 is moved along the groove 3.

The door 2 is an ordinary panel door made of glass, laminate, wood, metal, etc. In other words, any type of door can be used for the door structure of this invention without any material limitations.

As mentioned above, the retractable door structure of this invention includes the guide grooves 3 with the rack 5 formed therein so that the rack engages with the pinion 7 in the sliding blocks 6 fitted in the grooves. The sliding blocks 6 facing each other are connected with the connecting rod 9 so as to form a single unit. Therefore, the sliding door blocks 6 in the grooves 3 always slide the same distance together along the grooves with proper and precise coordination regardless of the points on the door where the pushing and pulling forces are applied on. Specifically, by means of the close contact of the sliding blocks 6 with the grooves 3 and the tight engagement of the pinion 7 with the rack 5, one of the sliding blocks is prevented from going ahead or behind the other sliding block. In other words, the door is pushed and pulled evenly every time it is moved along the grooves.

Consequently, even when the door 2 is pushed in or pulled out from any position in the cabinet, no distortion appear on the portions where the door is held. Thus, the problems such as damage to the door holding portions, breakage of the fitted portion on the door are all solved by this invention. Also, the door can be prevented from being stuck at the middle of opening or closing motions.

Fitting assemblies 10*a* in letter U shape, each being provided with rotary shaft 10, are attached at the corners of the door 2 , and the door 2 is held by the sliding blocks by mounting the shafts 10 into the fitting hole 6*e* of the sliding blocks 6. Thus, the door 2 is held by the shafts 10 which are apart from the rod 9 connecting the sliding blocks 6. Therefore, the door 2 can be supported by the shafts 10 in front of the rod 9 on the sliding blocks. As a result, the connecting rod 9 is kept behind the door 2. Also, the gap between the door 2 and the opening edge of the cabinet 1 can be limited to be within the fitting range of the door 2, that is, almost zero.

As should be apparent from the description given above, the retractable door frame structure of this invention, which has the foregoing characteristic features and effects, provides more reliable opening and closing movements of the door of a storage case and a good aesthetic appearance for the structure which not has been seen before.

We claim:

1. A retractable door structure for storage cases with a door which comes out of the storage case and rotates to open and close, the structure comprising:

a pair of opposing guide grooves provided inwardly from the front of the case;

a pair of elongated sliding blocks with one of said sliding blocks provided in each of the sliding grooves, each of said elongated sliding blocks having a scraped portion, said scraped portions opposingly facing each other;

a storing space provided in each of said elongated sliding blocks in a side of said sliding blocks opposing a bottom of each of said grooves;

a pinion mounted in said storage space in each of the sliding blocks;

a single rack provided on one side wall of each of the grooves, each of said racks engaging with one of said pinions;

a connecting rod provided between the sliding block and extending into each of said storing spaces wherein the pinions are fixed to both ends of the connecting rod and rotate together with said connecting rod; and a door rotatably mounted between the scraped portions of the sliding blocks by rotary shafts attached to the door such that said rotary shafts and said sliding blocks support the weight of said door.

2. A retractable door structure for storage cases according to claim 1, wherein the guide grooves are formed on the upper and lower portions of the inside of the case facing each other.

3. A retractable door structure for storage cases according to claim 1, wherein the guide grooves are formed facing each other on the upper and lower portions outside of one side of the case.

4. A retractable door structure for storage cases according to claim 1, wherein the guide grooves are formed facing each other on the upper right and left sides of the inside of the case.

* * * * *